United States Patent [19]

Chung

[11] Patent Number: 4,484,630

[45] Date of Patent: Nov. 27, 1984

[54] METHOD FOR RECOVERING HEAVY CRUDES FROM SHALLOW RESERVOIRS

[75] Inventor: Harold S. Chung, Dallas, Tex.

[73] Assignee: Mobil Oil Corporation, New York, N.Y.

[21] Appl. No.: 473,398

[22] Filed: Mar. 8, 1983

Related U.S. Application Data

[63] Continuation of Ser. No. 229,804, Jan. 30, 1981.

[51] Int. Cl.[3] ..... E21B 43/17; E21B 43/24

[52] U.S. Cl. ..... 166/263; 166/271; 166/272

[58] Field of Search ..... 166/271, 272, 263; 252/8.55 R, 8.55 B

[56] References Cited

U.S. PATENT DOCUMENTS

| | | | |
|---|---|---|---|
| 2,862,558 | 12/1958 | Dixon | 166/272 |
| 2,909,224 | 10/1959 | Allen | 166/305 R |
| 2,910,123 | 10/1959 | Elkins et al. | 166/271 |
| 3,221,813 | 12/1965 | Closmann et al. | 166/271 |
| 3,358,756 | 12/1967 | Vogel | 166/271 X |
| 3,400,762 | 9/1968 | Peacock et al. | 166/271 X |
| 4,068,716 | 1/1978 | Allen | 166/271 |
| 4,127,170 | 11/1978 | Redford | 166/271 X |
| 4,293,035 | 10/1981 | Fitch | 166/271 X |

FOREIGN PATENT DOCUMENTS 1495722 12/1977 United Kingdom .

*Primary Examiner*—Stephen J. Novosad
*Attorney, Agent, or Firm*—Alexander J. McKillop; Michael G. Gilman; Charles J. Speciale

[57] ABSTRACT

This invention provides in the production of heavy oil from a shallow subterranean tar sand bed penetrated by spaced injection and recovery systems, the method comprising:

(a) forming a plurality of horizontal fractures spanning the distance between said injection system and said recovery system, said fractures being spaced apart in a vertical direction with respect to each other throughout the depth of the tar sand bed;

(b) injecting a solvent for heavy oil and/or steam into said fractures, (c) shutting in the injection and recovery systems for a predetermined period of time to form a heavy oil/solvent mixture by gravity-driven convective mixing, and (d) recovering said heavy oil/solvent mixture in said recovery system by conventional recovery techniques.

2 Claims, No Drawings

METHOD FOR RECOVERING HEAVY CRUDES FROM SHALLOW RESERVOIRS

This is a continuation of copending application Ser. No. 229,804, filed Jan. 30, 1981.

BACKGROUND OF THE INVENTION

1. Field of the Invention

This invention is concerned with the production of heavy oil from shallow underground deposits of tar sands.

2 Description of the Prior Art

There are vast subterranean deposits of tar sands that are not susceptible to mining. For example, the Athabasca tar sands in Alberta Province, Canada, have been estimated to contain 860 billion bbls. with only 26 billion bbls. recoverable by current technology. Since the heavy oil in tar sands is highly viscous at ambient formation temperatures, it is not recoverable by ordinary production methods. Resort must be had to techniques to make the heavy oil more readily flowable, such as a suitable solvent or heat, or a combination thereof.

SUMMARY OF THE INVENTION

This invention provides in the production of heavy oil from a shallow subterranean tar sand bed penetrated by spaced injection and recovery systems, the method comprising:

(a) forming a plurality of horizontal fractures spanning the distance between said injection system and said recovery system, said fractures being spaced apart in a vertical direction with respect to each other throughout the depth of the tar sand bed;

(b) injecting a solvent for heavy oil and/or steam into said fractures, (c) shutting in the injection and recovery systems for a predetermined period of time to form a heavy oil/solvent mixture by gravity-driven convective mixing, and (d) recovering said heavy oil/solvent mixture in said recovery system by conventional recovery techniques.

DESCRIPTION OF SPECIFIC EMBODIMENTS

As used in the specification and claims, shallow subterranean tar sand beds are tar sand located at depths up to about 1,200 feet. At such relatively shallow depths, horizontal fractures can be formed by the application of hydraulic pressure greater than the overburden pressure.

The present invention is carried out in a subterranean tar sand bed that is penetrated by spaced injection and recovery systems extending from the surface of the earth into the tar sand bed. The injection system consists of one or more wells into which is introduced a suitable solvent, solvent mixture, and/or steam. The recovery system comprises one or more wells from which product is recovered. The wells in the injection and recovery systems are spaced apart and can be arranged in any desired pattern, such as patterns well known in waterflood operations. For example, the pattern can comprise a central injection well and a plurality of recovery wells spaced radially about the injection well.

A plurality of horizontal fractures are formed that span the distance between the injection system and the recovery system. The fractures are spaced apart in a vertical direction with respect to each other throughout the depth of the tar sand bed. The spacing between fractures can be any desired distance, although the method of this invention operates more efficiently when the fractures are relatively close to each other.

Any method known in the art can be used to form the fractures. The most feasible method, however, is hydraulic fracturing such as used in well stimulation.

Hydraulic fracturing techniques have been widely used for stimulating wells penetrating subterranean hydrocarbon-bearing formations by creating fractures which extend from the wells into the formation. These techniques normally involve injecting a fracturing fluid down a well and into contact with the subterranean formation to be fractured. A sufficiently high pressure is applied to the fracturing fluid to initiate a fracture in the formation and the fracturing fluid is injected down the well at a sufficiently high rate to propagate the fracture thereinto. Propping materials are normally entrained in the fracturing fluid and are deposited in the fracture to maintain the fracture open.

After the fractures have been established in the subterranean tar sand bed, a light solvent and/or steam is injected into the fractures. Some of the heavy oil may be displaced toward the recovery system, but more likely water or gas phase, which may also occupy pore space along with the oil, will be displaced. This gives the injected solvent increased mobility within the tar sand. The wells can be shut in for a predetermined period of time.

Due to the density difference between the in-place heavy oil and the injected solvent, gravity-driven convective mixing will occur. Since the separations between the fractures can be made rather small and since only a relatively minor amount of solvent is needed to be mixed with the heavy oil to reduce drastically the viscosity of the latter, the time required for the average in-place heavy oil to decrease to easily flowable levels will be short.

Considerable effort has been directed toward the selection of appropriate solvents or solvent systems for extraction of the organic constituents from tar sands. A list of known solvents for this purpose appears, for example, in British Pat. No. 1,495,722. Included among the solvents mentioned are aromatic hydrocarbons; aliphatic hydrocarbons; oxygen-containing compounds such as phenols, alcohols, aldehydes, ketones, ethers, and esters; aliphatic and aromatic amines; halogenated hydrocarbons; as well as sulfur compounds such as alkyl thiophenes and carbon disulfide.

After the convective mixing has taken place for a time sufficient to form a less viscous heavy oil/solvent mixture, it can be recovered using conventional techniques. Such techniques include waterflooding, gas injection, gas driven miscible solvent, polymer flood, chemical waterflood, in situ combustion, steam drive, or combination thereof. The performance of these recovery methods may be further improved, particularly with respect to increased volumetric sweep, by sealing the fractures and/or by collapsing the fractures via fluid injection at lower than reservoir overburden pressures. The heavy oil/solvent mixture is moved via the recovery system to the surface.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A method for the production of heavy oil from a shallow subterranean tar sand bed penetrated by at least one injection well and at least one spaced apart production well, comprising:

(a) forming a plurality of horizontal fractures spanning the distance between said injection well and said production well, said fractures being spaced apart in a vertical direction with respect to each other throughout the depth of the tar sand bed;

(b) injecting a solvent for the heavy oil into said fractures via said injection well;

(c) shutting in said injection well and said production well for a predetermined period of time to form a heavy oil/solvent mixture of reduced viscosity by gravity-driven convective mixing;

(d) collapsing said fractures via fluid injection at lower than reservoir overburden pressures (e) recovering said heavy oil/solvent mixture from said tar sand bed.

2. The method according to claim 1 which comprises additionally injecting steam into said fractures via said injection wells in step b.

* * * * *